United States Patent [19]

Joy

[11] Patent Number: 4,747,632

[45] Date of Patent: May 31, 1988

[54] AUDIBLE/TACTILE ENHANCER FOR REMOTE OPERATING HANDLE

[75] Inventor: Richard S. Joy, Royal Oak, Mich.

[73] Assignee: General Motors Corporation, Detroit, Mich.

[21] Appl. No.: 70,200

[22] Filed: Jul. 2, 1987

[51] Int. Cl.[4] ..... E05C 21/00

[52] U.S. Cl. ..... 292/347; 292/DIG. 31; 292/DIG. 61; 292/1; 292/204

[58] Field of Search ..... 292/336.3, 347, 216, 292/280, DIG. 25, DIG. 31, DIG. 61, DIG. 49, 256–269, 209, 113, 204, 1

[56] References Cited

U.S. PATENT DOCUMENTS

| | | | |
|---|---|---|---|
| 1,841,890 | 1/1932 | Hannon | 292/209 X |
| 2,265,167 | 12/1941 | Hothersall | 292/256.69 |
| 2,950,614 | 8/1960 | Evans | 292/347 X |
| 4,681,357 | 7/1987 | Vemura et al. | 292/347 X |

*Primary Examiner*—Richard E. Moore

*Attorney, Agent, or Firm*—Charles E. Leahy

[57] ABSTRACT

An operating handle mechanism for remotely actuating a closure latch including a handle mounted on a housing by a pivot. A coil spring anchored on the pivot has a first end seated on the housing and a second end seated on the handle to bias the handle to a normal unactuating position. A yieldable plastic button member mounted on the housing projects into the path of movement of the second end of the spring during actuating movement of the handle. During movement of the handle to the actuating position the second end of the spring is carried into engagement with the yieldable plastic button member and is temporarily unseated from the handle, and then snaps past the button member to again seat on the housing during further movement of the handle to the full actuated position, thereby providing a perceptible audible and tactile signal to the operator confirming actuation of the handle and the remote latch actuated thereby.

3 Claims, 1 Drawing Sheet

AUDIBLE/TACTILE ENHANCER FOR REMOTE OPERATING HANDLE

The invention relates to a handle mechanism for remotely actuating a closure latch in a vehicle body and more particularly provides mechanism associated with the handle for providing a perceptible audible and tactile signal to the operator confirming operation of the handle and the remote latch actuated thereby.

BACKGROUND OF THE INVENTION

It is known in motor vehicle bodies to provide an actuating lever inside the passenger compartment by which the vehicle operator can release a latch associated with a remotely located closure panel, such as a fuel filler door or a luggage compartment lid. Such a handle is typically pivotally mounted on a housing fixed in the passenger compartment and is connected with the remotely located closure latch by an actuating means such as a push-pull cable or an electrical switch operating a solenoid. In either case, a spring acts between the housing and the lever to position the handle at a normal unactuated position. The spring yields during pivoting movement of the handle to the latch actuating position and then returns the handle to the normal position.

It would be desirable to improve the remote actuating handle of the aforedescribed type by providing an audible and tactile signal, perceptible to the vehicle operator, to indicate that the handle has been actuated. This feature would be especially useful in applications such as a fuel filler door where the occupant seated inside the vehicle can not see whether his actuation of the release handle has indeed effected an unlatching of the remotely located closure latch.

SUMMARY OF THE INVENTION

According to the invention an improved operating handle mechanism for remotely actuating a closure latch includes a handle mounted on a housing by a pivot. A coil spring is anchored on the pivot and has a first end seated on the housing and a second end seated on the handle to bias the handle to a normal unactuating position. A projection, such as a yieldable plastic button member is mounted on the housing and projects into the path of movement of the second end of the spring during actuating movement of the handle. Accordingly, during movement of the handle from the unactuating position, the second end of the spring is carried into engagement with the yieldable plastic button member and is temporarily unseated from the handle, and then snaps past the button member to again seat on the housing during further movement of the handle to the full actuated position, thereby providing a perceptible audible and tactile signal to the operator confirming actuation of the handle and the remote latch actuated thereby.

BRIEF DESCRIPTION OF THE DRAWINGS

These and other features, objects and advantages of the invention will become apparent upon consideration of the following description of the preferred embodiment and the appended drawings in which.

DESCRIPTION OF THE PREFERRED EMBODIMENT

Figure 1:
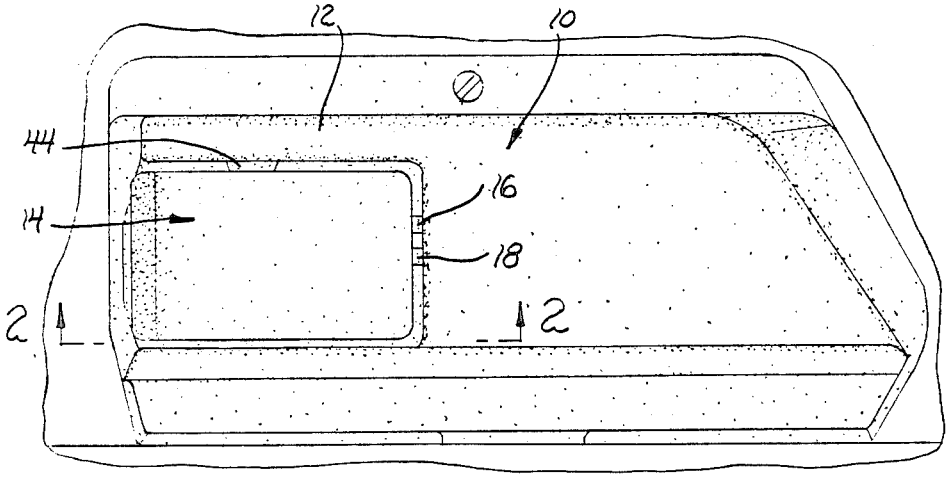
FIG. 1 is a plan view of an operating handle mechanism mounted in the vehicle body.

In FIG. 1 it is seen that the operating handle mechanism, generally indicated at 10 includes a housing 12 having a handle 14 mounted thereon.

Figure 2:
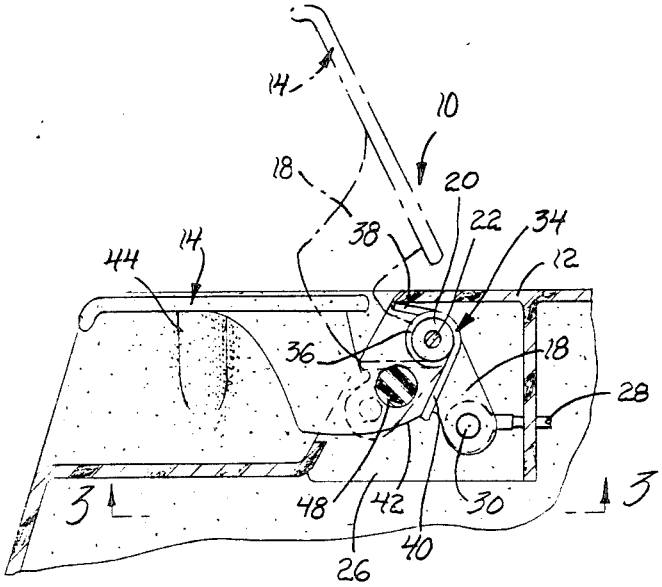
FIG. 2 is a side elevation view of the operating handle mechanism having parts broken away in section and showing the actuated position of the handle in phantom line.
Figure 3:
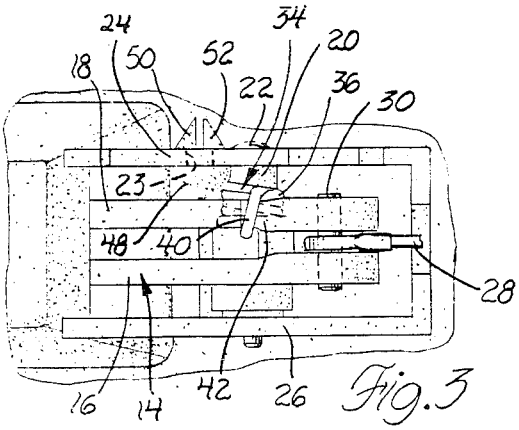
FIG. 3 is a sectional view taken in the direction of arrows 3—3 and showing the handle in the unactuated position.
Figure 4:
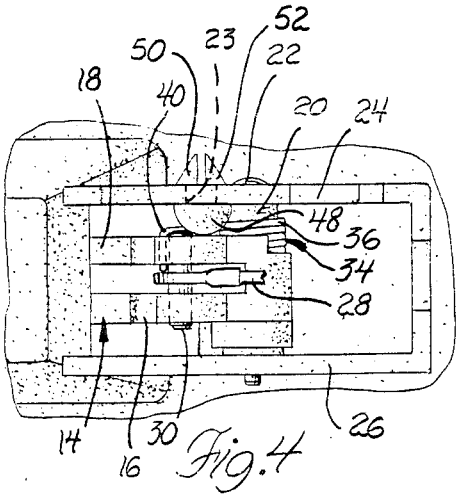
FIG. 4 is a view similar to FIG. 3 but showing the position of the handle corresponding to the phantom line indicated actuated position of FIG. 2.

In FIGS. 2 and 3 it is seen that the handle 14 includes a pair of spaced apart mounting arms 16 and 18 which connect with an integrally molded cylindrical boss 20. The boss 20 has a central bore which receives a pivot pin 22 which spans between walls 24 and 26 of the housing.

The handle 14 is connected with the remotely located closure latch, not shown, by a push-pull cable 28 which is attached to the spaced apart arms 16 and 18 of the handle 14 by an anchor pin 30.

A coil spring 34 acts between the housing 12 and the handle 14 to bias the handle 14 to the normal unactuated position shown in FIGS. 2 and 3. Coil spring 34 includes a spring coil 36 which surrounds the cylindrical boss 20, a first spring end 38 which seats against the housing 12 and a second spring end 40 which seats within a recess 42 of the arm 18 of the handle 14. As best seen in FIG. 2, the spring arm 40 is constantly urged in a counterclockwise direction to thereby urge the handle 14 counterclockwise to its normal rest unactuated position of FIG. 2. A stop 44 is molded integrally with housing 12 and is engaged by the underside of handle 14 to stop the handle 14 at its normal position.

As seen in FIGS. 2 and 3 a plastic button 48 is mounted on the face of the upper housing wall 24 by a pair of resilient legs 50 and 52 which snap through a hole 23 in the wall 24. As best seen in FIG. 3 the button 48 extends and projects from the wall 24 into the path of movement of the spring end 40 during pivotal movement of the handle 14 from its normal unactuated position of FIG. 2 to the phantom line indicated position of FIG. 2. Accordingly as the handle is lifted from the FIG. 2 unactuated position to the phantom line indicated position, the spring arm 40 will snap past the button 48 as permitted by a yielding interaction between the spring end 40 and the bumper 48. This yieldable interaction is a combination of the yieldability of the spring leaf 40, the yieldability of the resilient material of the button 48, and also the flexure of the housing wall 24. As the spring arm 40 snaps past the button 48, the end of the spring end 40 is momentarily disengaged from its seat upon the lever 40 and then snaps back into such an engagement, thereby providing an audible indication of the degree of travel of the handle 14 so that the operator obtains confirmation that the closure panel will have been unlatched. Furthermore, as seen in FIG. 2 the passage of the spring arm 40 past the button 48, first in the clockwise direction during lifting of the handle, and then subsequently in the counterclockwise direction during return of the handle to the lowered position, the resists effort applied to the handle by the operator so that the operator receives a tactile confirmation of the unlatching of the closure panel.

Thus it is seen that the operation of a remote actuating handle mechanism is enhanced by adding a plastic button which projects into the path of movement of a passing spring acting between the handle and the housing so that a tactile and audible signal is provided to the operator thereby providing confirmation of the effective unlatching of the remotely located closure panel latch.

The embodiments of the invention in which an exclusive property or privilege is claimed are defined as follows:

1. An improved operating handle mechanism including a handle pivotally mounted on a housing for remotely actuating a closure latch in a vehicle body via an actuating means extending between the handle and the latch, comprising:

spring means having a first end seated on the housing and a second end seated on the handle and acting to bias the handle to an unactuated position, and means projecting from the housing into the path of movement of the second end of the spring during actuating movement of the handle so that the second end of the spring and the means projecting from the housing are temporarily and yieldably engaged with one another during further movement of the handle to the actuating position, thereby providing a perceptible audible and tactile signal to the operator confirming actuation of the handle and the remote latch actuated thereby.

2. An improved operating handle mechanism including a handle mounted on a housing for remotely actuating a closure latch in a vehicle body via an actuating means extending between the handle and the latch, comprising:

pivot means pivotally mounting the handle on the housing, a coil spring anchored on the pivot means and having a first end seated against the housing and a second end seated against the handle to bias the handle to an unactuating position, means mounted on the housing and projecting into the path of movement of the second end of the spring during actuating movement of the handle so that the second end of the spring engages the projection and is temporarily unseated from the handle and then snaps past the projection to again seat upon the handle during further movement of the handle to the actuating position, thereby providing a perceptible audible and tactile signal to the operator confirming actuation of the handle and remote latch actuated thereby.

3. The operating handle mechanism of claim 2 further characterized by said means mounted on the housing and projecting into the path of movement of the second end of the spring during actuating movement of the handle being a yieldable plastic member carried by the housing.

* * * * *